US006416448B1

(12) United States Patent
Hassler

(10) Patent No.: US 6,416,448 B1
(45) Date of Patent: Jul. 9, 2002

(54) THERAPY AND TRAINING DEVICE

(75) Inventor: Andreas Hassler, Ranhertetetten 6, Rohrdorf DE-83101 (DE)

(73) Assignee: Andreas Hassler, Rohrdorf (DE)

( * ) Notice: Subject to any disclaimer, the term of this patent is extended or adjusted under 35 U.S.C. 154(b) by 0 days.

(21) Appl. No.: 08/930,338

(22) PCT Filed: Mar. 20, 1996

(86) PCT No.: PCT/EP96/01209

§ 371 (c)(1),
(2), (4) Date: Mar. 9, 1998

(87) PCT Pub. No.: WO96/29040

PCT Pub. Date: Sep. 26, 1996

(30) Foreign Application Priority Data

Mar. 20, 1995 (DE) ..... 195 09 465
Aug. 29, 1995 (DE) ..... 195 31 833

(51) Int. Cl.[7] ..... A63B 21/22
(52) U.S. Cl. ..... 482/131; 482/51; 482/113
(58) Field of Search ..... 482/60, 51, 52, 482/113, 121, 125, 904, 131

(56) References Cited

U.S. PATENT DOCUMENTS 2,772,881 A 12/1956 Fundom et al.
4,229,001 A 10/1980 Roman ..... 482/79
4,569,336 A 2/1986 Wheeler
4,930,497 A 6/1990 Saringer
4,946,162 A * 8/1990 Lubie ..... 482/113

FOREIGN PATENT DOCUMENTS

| | | |
|---|---|---|
| DE | 30 37 619 | 5/1982 |
| DE | 36 38 094 | 5/1988 |
| EP | 0 057 609 | 8/1982 |
| EP | 0 590 973 | 4/1994 |
| GB | 2 096 006 | 10/1982 |
| WO | WO 93/04655 | 3/1993 |

OTHER PUBLICATIONS

European Search Report of Corresponding Application, PCT/EP 96/01209.
Derwent Abstract for DE 36 38 094.
Derwent Abstract for DE 30 37 619.

* cited by examiner

*Primary Examiner*—Glenn E. Richman
(74) *Attorney, Agent, or Firm*—Darby & Darby

(57) ABSTRACT

Therapy and training equipment for constrained knee-joint movement with a lower leg accommodating arrangement, and a guiding arrangement, the arrangements being connected to one another via an articulated device, the guiding arrangement (12) cooperates with the lower leg accommodating arrangement (11, 25) in such a way that, on a rotational movement of one of the lower legs (14), the other lower leg (15) is constrained to move as a result of the knee-bending movement.

6 Claims, 10 Drawing Sheets

FIG 11
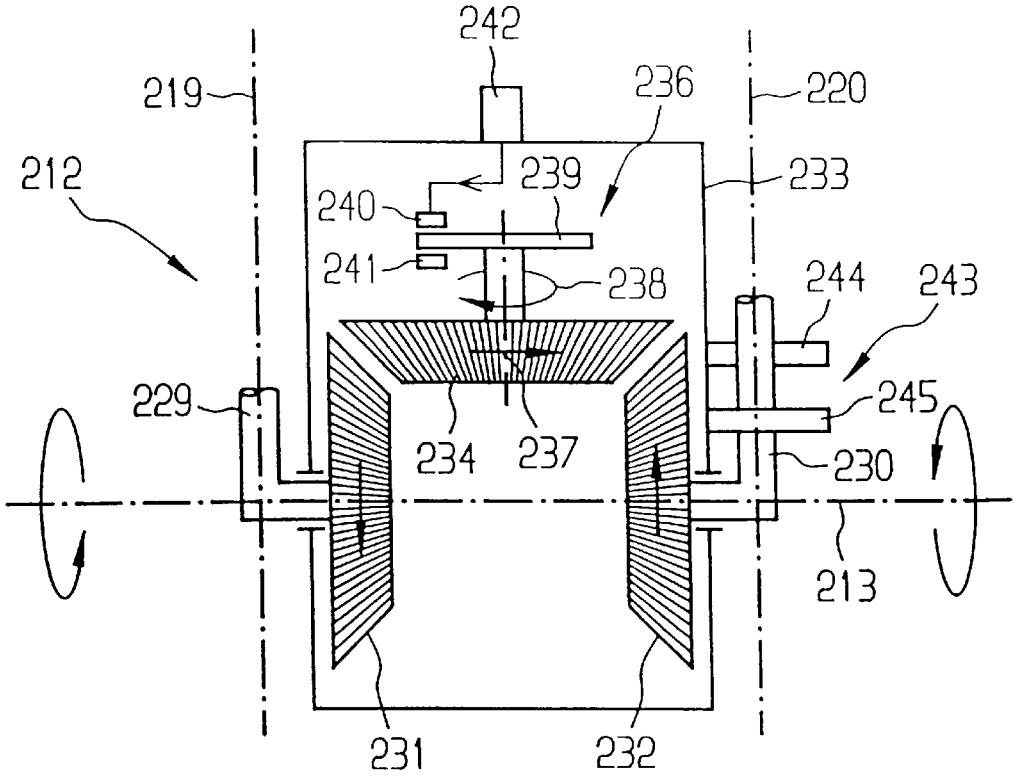
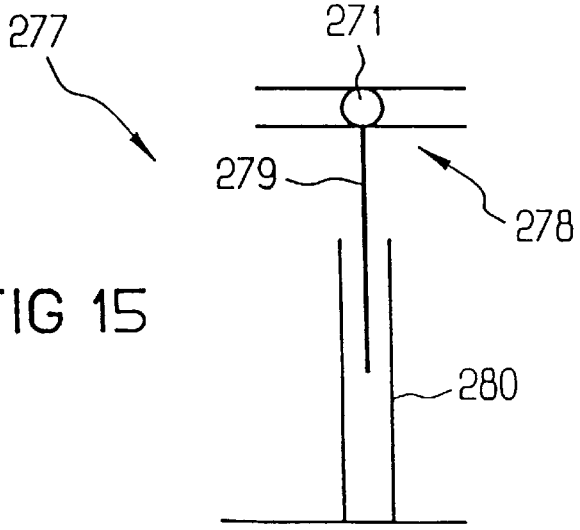
FIG 15

THERAPY AND TRAINING DEVICE

FIELD OF THE INVENTION

The present invention relates to therapy and training equipment for constrained knee-joint movement with a lower leg accommodating arrangement and a guiding arrangement, which arrangements can be rotatably connected to one another via an articulated device.

1. Background of the Invention

Knee injuries and the associated knee operations frequently require a prolonged immobilisation of the knee-joint, which leads to a general weakening and impairment of the leg musculature and to restrictions in movement. Appropriate medical aids are therefore used in the treatment of knee injuries or in the post-operative period, which are designed to reduce the restrictions in movement or to counteract, by performing specific movement exercise, the incidence of restricted movement.

Particularly after a crucial ligament operation so-called motor driven rails are used to rehabilitate the joint. These motor driven rails serve to accommodate the injured leg and are provided with a drive device that permits a rotation of a lower leg receptacle relative to a thigh receptacle. This produces a knee-joint, movement, substantially free of any weight loads, so that the mobility of the knee joint can be trained without any damaging weight loads on the ligaments. The disadvantage of the known motor-driven rail is that, on the one hand, a drive (generally an electrical drive) is required to move the motor driven rail, and on the other hand the healthy leg is not involved in the movement, with the result that, particularly in the case of prolonged rehabilitation measures, there is a needless weakening and impairment of the musculature of the healthy leg. With a motor driven rail only a passive exercising of the musculature and tendons is thus possible. Furthermore, motor-driven rails are expensive to purchase on account of their motorised drive, which makes it difficult to carry out such rehabilitation measures, desirable per se, except in hospitals and clinics with technically sophisticated equipment and a corresponding procurement budget. Also, patients have found it difficult to handle and adapt individually to motor driven rails, with the result that these activities generally have to be carried out by trained care staff.

Cable pull arrangements are known, which are substantially simpler devices and can be used for movement therapy on a knee joint, and can be installed on a frame device at the patient's bed and, when coupled to a cable pull, can facilitate movements of the injured leg initiated by the health leg. However, a disadvantage with such cable pull arrangements is that the movement coupling between the healthy leg and the injured leg is not kinematically unambiguous, in other words it does not take place in a constrained manner, and for example there are degrees of freedom of movement in the direction opposite to the cable pull direction or even transverse thereto, which can allow movements that are harmful for the rehabilitation of the knee-joint.

Such cable pull arrangements are therefore also unable to replace the aforedescribed complicated and costly motor-driven rails.

2. Background of the Prior Art

This object is achieved by a device and equipment having the features of claim 1.

SUMMARY OF THE INVENTION

In the device and equipment according to the invention the guiding arrangement cooperates with the lower leg accommodating arrangement in such a way that, on a rotational movement of one of the lower legs.

By coupling the lower leg accommodating arrangement, which serves to receive the patient's lower leg, to a guiding arrangement, which permits a movement of the lower leg simply along a predetermined movement path, an exactly defined knee-joint movement is provided that excludes damaging loads on the knee-joint. In the therapy and training equipment according to the invention the drive for the load-free movement of the injured leg is provided by a force actuated movement of the healthy leg, with the result that on the one hand an external drive can be dispensed with, while on the other hand the healthy leg at the same time experiences a specific training effect to strengthen the leg musculature, the movements of both the injured leg and healthy leg constituting an effective prophylaxis against thrombosis.

The expression "lower leg accommodating arrangement" used here is intended also to include the possibility of fixing the lower leg for instance on the outside, lying on a rail like device. The essential point is to fix the lower leg in a defined manner that allows the aforedescribed movement sequence.

Advantageous embodiments of the equipment according to the invention are the subject of claims 2 to 4.

In the embodiment according to claim 5 the guiding arrangement is designed as a thigh receptacle, and the lower leg receptacle serves for the movement-coupled accommodation of both lower legs in such a way that, on rotational movement of one of the lower legs, the other lower leg is constrained to move as a result of the knee bending movement. With this therapy and training equipment a force-free movement of the injured leg can thus be achieved by a force actuated movement of the healthy leg. Through the coupled movement of the healthy leg and injured leg the injured leg is constrained to move during the movement of the healthy leg.

In this way it is on the one hand possible to dispense with a motor drive to effect a load-free movement of the injured leg, while on the other hand the musculature of the healthy leg is trained and toned up by the use of the healthy leg to "drive" the injured leg. In addition there is a propioceptive beneficial effect for the sensory motor control of the injured knee-joint.

In addition to the use of the therapy and training equipment to treat an injured leg, the said equipment can also be used purely as a training or sports equipment to train and tone up the leg musculature of both legs.

If, as is the case in a preferred embodiment, the articulated device is arranged so that its rotational axis is coaxial with the rotational axis of the knee-joints, this ensures that the knee joints are not subjected to turning moments and transverse forces that would otherwise occur if the two rotational axes were not coaxial.

It has proved particularly advantageous if the lower leg receptacle is provided in the heel region with a sliding or roller guide so that it is possible for the lower leg receptacle to slide over a suitably shaped underneath surface when the knee joint moves. This arrangement enables the therapy and training equipment to be used when the patient is supine, i.e. when the patient's buttocks and heels lie substantially in one plane and movement of the injured leg is effected by bending the healthy leg. Especially when using a roller guide, which places fewer demands on the flattest possible shape of the aforementioned underneath surface, the therapy and training equipment can thus be used in a patent's bed.

In order to set and adjust, a specific knee-bending range that is formed to be particularly advantageous for the treatment of the injured leg, the articulated device of the therapy and treatment equipment can be provided with two varying angle stops.

It has proved to be particularly advantageous, especially when using the therapy and training equipment in the patient's bed, if the articulated device is provided with a fixing and locking device for the variable adjustment of a fixed knee-bending position. In this way it is possible to lock the articulated device in a knee-bending position comfortable for the patient in question and thereby establish a rest position in which the patient can remain for a relatively long time without experiencing unpleasant tensions and strains, and without having to remove the therapy and training equipment, beforehand and re-install it when the movement therapy is resumed. This turns out to be particularly important since such therapies are often performed in so-called interval or staggered mode, with more or less long pauses between successive movement sections.

If the articulated device is provided with a movement counter, which may for example be in the form of an inductive rotational angle sensor, it is thereby particularly simple to monitor the movement training carried out with the therapy and training equipment.

In order to be able to influence the load acting on the healthy leg during the movement training, a loading device, which in a particularly advantageous embodiment is a spring device, can be arranged to act between the thigh receptacle and the lower leg receptacle. By simply adjusting the spring pretensioning, the spring device permits an accurate presetting of the load acting on the healthy leg during the movement training of the injured leg.

In a simple and consequently particularly advantageous embodiment the spring device may be designed as a cable pull spring, i.e. as a resilient and elastic cable. In another embodiment of the therapy and training equipment, a compression spring may be provided. Accordingly, in the first case it is possible to load basically the knee-bending muscle, and in the second case there is the possibility of loading and suitably training basically the knee-stretching muscle, so that a differentiated muscle training can be performed on the healthy leg.

As regards the movement training for the injured leg or knee-joint as well as the muscle training for the healthy leg, the therapy and training effect can be further improved if, in addition to the loading device—which in a particularly advantageous embodiment is in the form of a spring device—a damping device is actively provided between the thigh receptacle and the lower leg receptacle. In this way it is possible to execute a movement that is uniform as regards the movement speed, i.e. is isokinetic.

In order to be able to compensate possible incorrect settings of the patient's injured and/or healthy leg, which can lead to tensions in the knee region if the lower legs are immobilised in a certain position, the lower leg receptacle may be provided with at least one guide adjustable as regards its arrangement relative to the lower leg receptacle. Overlapping superimposed movements of the lower legs are thereby possible on bending the knee, so that the thighs can move not only in a plane of rotation, but also at right angles thereto.

The lower leg receptacle as well as the thigh receptacle can be formed like a capsule, for example from plastics material, and provided with guides for the longitudinally alterable accommodation of rotating arms connected to the articulated device. It is particularly advantageous if the guides are formed integrally in the lower leg receptacle and the thigh receptacle. On the one hand this reduces the number of parts involved in the therapy and training equipment, and on the other hand correspondingly reduces the work involved in assembling the therapy and training equipment.

If the articulated device is designed so that two rotating joints arranged in the outer region of the knee are provided, on which in each case two rotating arms are arranged for connection to the thigh receptacle and the lower leg receptacle, a particularly torsionally rigid form of the therapy and training equipment is provided with minimal effort, and cost.

With regard to ensuring a small number of paris, it has also been found particularly advantageous if a thigh securement device provided to secure the thigh to be thigh receptacle is designed so that, it can be used alternately for both thighs. The same comments also apply to a lower leg securement device.

In order to adjust a loading preset by the spring device, at least one spring coupling point may be designed so as to be adjustable.

The embodiment according to claim 22 has a guiding arrangement designed as the rotating joint axis of a rotating joint arrangement. The rotating joint axis can be altered in its relative arrangement with respect to a patient's hip-joint rotation point. Lower leg receptacles are coupled to the articulated joint arrangement, the said receptacles being coupled as regards their movement in such a way that a rotational movement of one lower leg receptacle about the rotating joint axis produces a rotational movement in the opposite direction of the other lower leg receptacle. By accommodating the patient's legs in the lower leg receptacles, the constrained rotational movement occurs about the rotational axis of the articulated joint arrangement, so that force directions that are harmful to the knee joint are excluded. The adjustability of the spatial arrangement of the rotating joint axis relative to a patient's hip-joint rotation point permits a setting of the rotating joint axis congruent with the knee joint rotation points and thus ensures isometric conditions. This too helps to prevent harmful loads, such as occur for example during an axial displacement of the femur over the libia (known as the "chest of drawers" effect), acting on the knee joint.

Since in this embodiment the rotational movement of one lower leg receptacle is produced by an oppositely directed rotational movement of the other lower leg receptacle, a bending movement of the healthy leg can be used to produce a corresponding bending movement of the injured leg without having to employ a complicated and costly drive mechanism. By virtue of the aforedescribed movement coupling, the frequency of the knee-bending movements can be controlled by the patient himself at any time up to a discontinuance of the rotational movement, which means that the equipment according to the invention can be used by the patient himself at any time. Just as few trained staff need to be employed to monitor the operation of the equipment since the latter can easily be manipulated by the patient himself at all times. On account of the ease of operation of the equipment and the absence of a drive device, the equipment is also found to be substantially more economical as regards procurement and operating costs.

Instead of a purely passive exercising, as is possible with the known motor driven rail, the equipment according to the invention permits an active exercising with a natural, physiological movement sequence. The reciprocal movement initiated by the movement coupling effect promotes cartilage and tendon formation.

In addition, the equipment can be used without any alteration both as a passive movement appliance and an active training appliance, so that for example with continuing ongoing rehabilitation of the knee-joint the regime can be changed easily and smoothly to an exercise regime involving active movement of the knee-joint.

It is found to be particularly advantageous if the rotational movement occurs in movement range that has a middle position in which the lower leg receptacles have an identical rotation position. In this way the patient using the equipment is able to adopt, in the middle position, a particularly comfortable rest position in which the lower legs are at the same height. It is also possible to leave the equipment connected to the patient between successive treatment sequences without causing any inconvenience for the patient. Indeed, patients often feel comfortable with the legs in a raised position.

This also provides for a particularly good accessibility of knee-joints and legs during treatment, with the result that it is possible for example to check the healing process and the wound or also carry out cryotherapy while the equipment is connected to the patient.

It is also found to be advantageous if the end positions of the rotational movement range can be adjusted relative to the middle position so that the optimum rotational movement range can be adjusted quite specifically to rehabilitate a restricted movement of the knee-joint.

If the mid position of the lower leg receptacles can be adjusted as a rotational angle position with respect to the rotating joint axis of the rotating joint arrangement, a rest position for the patient's legs can be arbitrarily chosen as required, in which both legs are bent to the same extent in order to take into account in particular the individual patient's needs.

It is also possible to fix the mid position and/or the end positions of the rotational movement range in order to ensure if necessary that no knee-joint bending movements are possible beyond these positions.

If the movements of the lower leg receptacles are coupled via a rotating joint arrangement in the form of a gear mechanism, a particularly compact design and manufacture of the whole equipment is possible since the rotating joint arrangement is simultaneously used as a force transmission device.

In particular, if it is intended to use the equipment not only as therapy equipment but also as exercise equipment to build up and/or restore the leg musculature, it has been found particularly advantageous to provide a loading device that acts at least in a phase-like manner against the rotational movement on at least one lower leg receptacle. On the one hand the already described effect of the equipment is intensified since the musculature of the healthy leg used to "drive" the movement of the injured leg is at the same time trained. On the other hand the effect is also enhanced since, through the actuation of the healthy leg, the injured leg is passively exercised as a result of the crossed exercising of the quadriceps.

If furthermore the loading device is adjustable, the latter can be matched in a particularly simple way to the capabilities and needs of the patient.

Such a loading device may be formed for example by a suitable spring or spring/damper arrangement.

If the rotating joint arrangement is designed as a gear mechanism to transmit the force between the lower leg receptacles, it is found to be particularly advantageous to provide the rotating joint arrangement or the gear mechanism with a gear loading system. This can be achieved for example by means of a torque brake integrated in the gear mechanism. Here too it is advantageous if the gear load and/or the brake can be adjusted.

If the rotating joint arrangement is coupled to a height adjustment device, it is possible to control the desired rotational movement range not only by adjusting the end positions of the rotational movement of the lower leg receptacles, but also by adjusting the height of the rotating joint arrangement or of the rotating joint axis.

It is also particularly advantageous if the relative arrangement of the rotating joint axis with respect to the hip joint rotation point can be altered along a movement path of the said rotating joint axis. In this way it is possible to superimpose rotational movements of the thighs about the hip-joint rotational axis on rotational movements of the lower leg receptacles about the rotating joint axis and rotational movements of the lower legs about the knee joint rotational axis, in order thereby to be able to simulate particularly realistic movement sequences such as occur during walking or running.

In order to achieve an optimum congruent setting between the rotating joint axis and the knee joint axes, the lower leg receptacles may be made adjustable as regards their alignment relative to the rotating joint axis.

In order to accommodate the lower legs in the lower leg receptacles in a manner particularly comfortable for the patient, the receptacles may be adjustable as regards their length.

Furthermore, the lower leg receptacles may be provided at their free ends with foot rests.

If the foot rests can rotate about an axis transverse to the longitudinal axis of the lower leg receptacles, the rotational movements of the said lower legs can be augmented by rotational movements of the feet about the ankle rotational axis, which produces an effective prophylaxis against thrombosis since the activation of the fibular pump promotes venous blood flow.

If furthermore the movements of the foot rests are coupled in such a way that a rotational movement of one of the foot rests produces a rotational movement in the opposite direction of the other foot rest, it is then for example also possible to use the equipment for movement therapy on an ankle, in a similar way to the movement therapy on a knee joint.

If the movements of the foot rests are coupled to the lower leg receptacles in such a way that a rotational movement of a lower leg receptacle produces a rotational movement in the same or opposite direction of the foot rest arranged on the respective lower leg receptacle, the coupled movement of the lower leg receptacles can at the same time also be utilised for the constrained rotation of the foot rests.

The installation of the equipment on the patient is particularly facilitated if the lower leg receptacles are formed an capsules having at least one securement device arrangement opposite a capsule opening. In this way it is possible to insert the lower legs in the lower leg receptacles and secure them therein with the aid of the securement device.

The utility of the equipment can be improved still further if the securement device is formed as a laterally open strap or hoop so as to permit a lateral insertion or removal of the lower legs.

BRIEF DESCRIPTION OF THE DRAWINGS

Embodiments of the equipment according to the invention will be described hereinafter with reference to the accompanying drawings, in which:

FIG. 11 shows a rotating joint arrangement designed as a gear mechanism, of the therapy equipment illustrated in FIG. 10;

FIG. 15 is a diagrammatic illustration of a rotating joint axis guide permitting the movement path of the rotating joint axis illustrated in FIG. 14.

DETAILED DESCRIPTION

Figure 1:
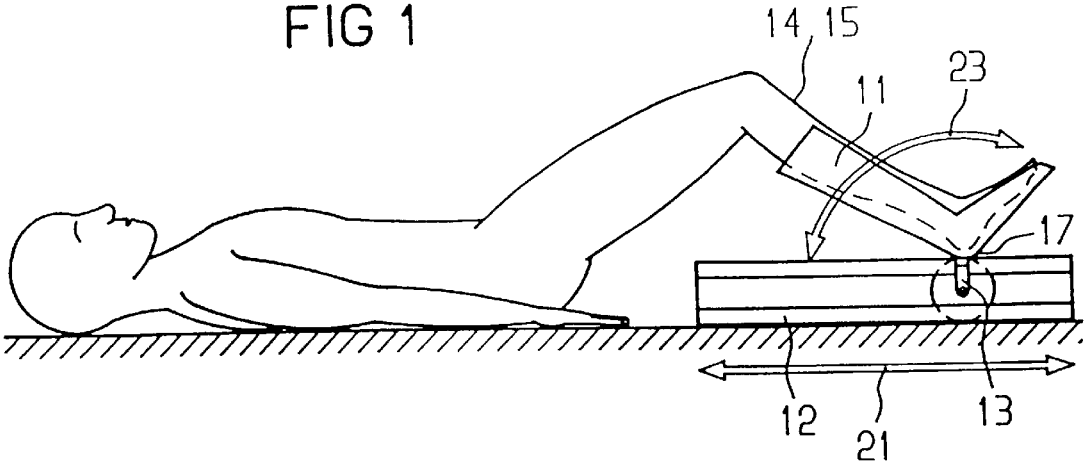
FIG. 1 is a first embodiment of a therapy and training equipment installed on a patient in a middle knee bending position.

FIG. 1 shows a therapy and training equipment 10 in use on a patient. The therapy and training equipment 10 has a lower leg accommodating arrangement 11 that is constrained to move relative to a guiding arrangement, shown here as a guide rail 12, by means of an articulated device 13 that connects the lower leg accommodating arrangement 11 to the guide rail 12.

Figure 2:
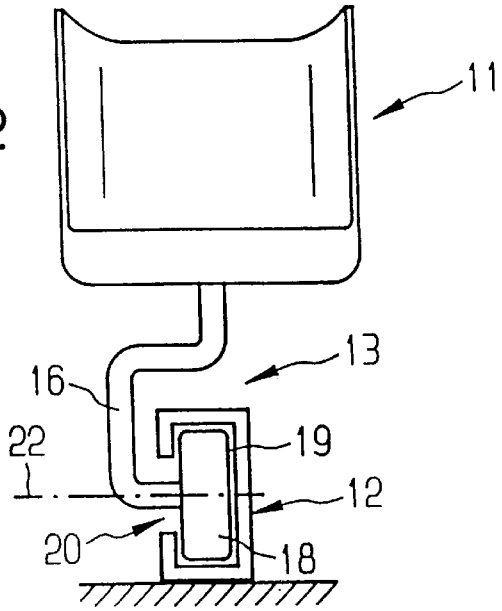
FIG. 2 is a side view of the therapy and training equipment shown in FIG. 1.

FIG. 2 shows the lower leg accommodating arrangement 11, in this case suitable for the parallel accommodation of both lower legs 14, 15, together with the articulated device 13 arranged thereon and engaging in the guide rail 12.

The articulated device 13 has an articulated lever 16, shown here bent twice at right angles, which is rigidly connected at one end to a heal part 17 (FIG. 1) of the lower leg accommodating arrangement 11. At the other end of the articulated lever 16 is arranged a circular articulated disc 18, which in the structurally particularly simple example illustrated here is rigidly connected to the said articulated lever 16. The articulated disc 18 is inserted in a guide channel 19 of the guide rail 12, which is formed here as rectangular tube with a longitudinal channel 20 for engaging the articulated lever 16.

As will be apparent on examining FIGS. 1 and 2 in conjunction, the articulated device 13 permits a horizontal longitudinal guided movement in the direction of the double arrow 21, on which can be superimposed a rotational movement about a mid axis 22 of the articulated disc 18 in the direction of the double arrow 23. The therapy and training equipment 10 illustrated in FIG. 1 thus permits a movement sequence such as is necessary for executing a bending and stretching of the legs of the patient shown in FIG. 1, further movements, for example transverse to the longitudinal direction of the guide rail 12, moreover being impossible.

Figure 3:
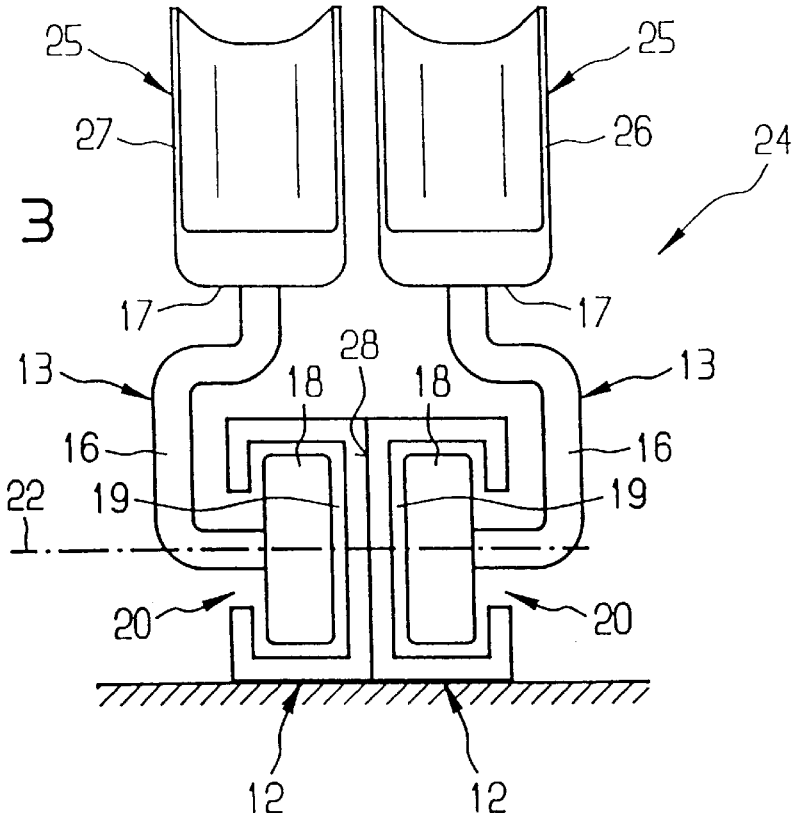
FIG. 3 is an illustration corresponding to the view shown in FIG. 2 of a further embodiment of the therapy and training equipment illustrated in FIG. 1.
Figure 4:
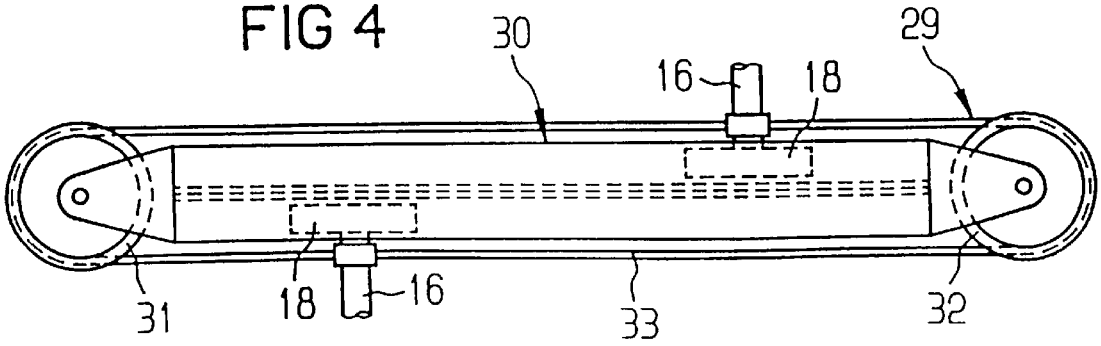
FIG. 4 is a plan view of a guiding arrangement used in the therapy and training equipment according to FIG. 3.

In contrast to the therapy and training equipment 10 illustrated in FIGS. 1 and 2, which permits a parallel movement of the lower legs 14, 15 in the same direction, FIGS. 3 and 4 show a therapy and training equipment 24 that permits a movement of the lower legs 14, 15 in opposite directions.

To this end the therapy and training equipment 24, as illustrated in FIG. 3, has a lower leg accommodating arrangement 25 with two lower leg receptacles 26, 27, each of which has on its huel part 17 an articulated device 13 of the type illustrated in FIG. 2. Both articulated devices 13 are guided together with their articulated discs 18 in each case in a guide rail 12 arranged with their closed high sides 28 abutting one another, so that the longitudinal channels 20 for engaging the articulated levers 16 are in each case arranged on the outside.

As will become clear from FIG. 4, the movements of the lower leg receptacles 26, 27 are coupled by means of a cable guide device 29 connecting the articulated levers 16 of the lower leg receptacles 26, 27 to one another.

The cable guide device 29 has two guide rollers 31, 32, each arranged at one end of a guide rail arrangement 30 formed from two guide rails 12. A cable 33 is guided over the rollers 31, 32, and connects the articulated levers 16 to one another so that, irrespective of the direction of movement, a longitudinal movement of one of the articulated levers 16 in the associated guide rail 12 produces a longitudinal movement in the opposite direction of the other articulated lever 16 in its associated guide rail 12. In this way, a movement of the healthy leg accommodated in the lower leg receptacle 26 induces a corresponding counter movement of the injured leg accommodated in the other lower leg receptacle 27.

In order to permit a particularly friction-free operation of the therapy and training equipment 10, 24, illustrated in FIGS. 1 to 4, the articulated discs 18 may be arranged mounted on ball bearings on the articulated levers 16 or alternatively may themselves be in the form of ball bearings.

Figure 5:
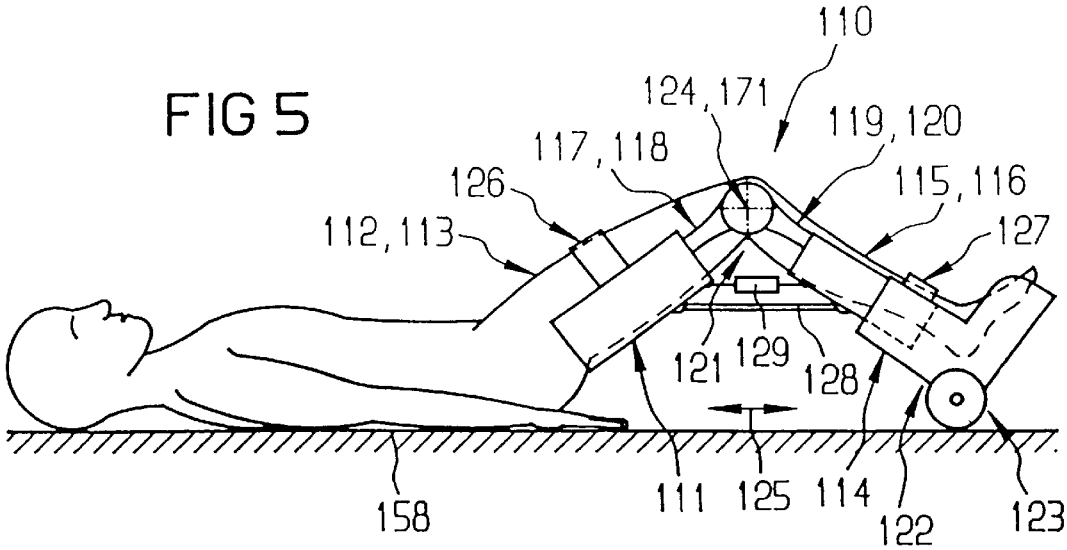
FIG. 5 is a further embodiment of a therapy and training equipment installed on a patient in a middle knee-bending position.

FIG. 5 shows a therapy and training equipment 110 that is installed on a patient lying in the supine position. The therapy and training equipment 110 illustrated here is fixed in a middle knee-bending position with a knee-bending angle of about 110°. The therapy and training equipment 110 has a thigh receptacle 111 for accommodating both thighs 112, 113, and a lower leg receptacle 114 for accommodating both lower legs 115, 116, of the patient. The thigh receptacle and the lower leg receptacle are connected to one another via rotating arms 117, 118 and 119 and 120 of an articulated device 121.

The lower leg receptacle 114 is provided in a heel region 122 with a roller guide 123 that permits, on a rotational movement about a rotational axis 124 of the articulated device 121, the lower leg receptacle 114 to roll backwards and forwards on an underneath support 158 in the direction of the arrow 125. The rotational axis 124 is arranged coaxially with a rotational axis 171 of the knee joints. The underneath support 158 may be formed by a floor or also by another supporting surface that allows the roller guide 123 to roll backwards and forwards. Accordingly, a bed mattress may also serve as underneath support 158.

In order to ensure that the thighs 112, 113 lie on the thigh receptacle 111 and the lower legs 115, 116 lie on the lower leg receptacle 114 throughout the relative movement of the lower leg receptacle 114 with respect to the thigh resolution 111, the said thigh receptacle 111 has a thigh securement device 126 and the lower leg receptacle 114 has a lower leg securement device 127.

As follows from the illustration shown in FIG. 5, a spring device, shown here as a cable pull spring in the form of a rubber elastic cable 128, may be actively installed between the thigh receptacle 111 and the lower leg receptacle 114, which spring device permits the conversion of the therapy and training equipment 110 from a knee-bending mode to a knee-stretching mode only by overcoming the spring force on the cable 128.

In the embodiment illustrated in FIG. 5, a spring device 128 acting as a tension spring is provided, which forces the therapy and training equipment 110 from a knee-stretching position to a knee-bending position. In addition to the movement training for the injured leg it is thus possible to provide a muscle training for the healthy leg, which primarily loads the thigh muscle known as the extensor. If instead of a tension spring a compression spring is used for the spring device 128, it is possible to superimpose a muscle strengthening and training for the bending muscle of the healthy leg on the movement training of the injured leg.

In addition to the spring device 128, in the embodiment of the therapy and training equipment 110 illustrated in FIG. 5 a damping device 129, shown here only diagrammatically, is provided to act between the thigh receptacle 111 and the lower leg receptacle 114, the said damping device enabling a uniform relative movement as regards speed to be produced between the thigh receptacle 111 and the lower leg receptacle 114, independently of the compression spring behaviour dependent on the deflection of the spring device 128. Although in the representation shown in FIG. 5 these devices are separate built-on structural parts, it is also possible to integrate the spring device 128 as well as the damping device 129 in the articulated device 121.

Figure 6:
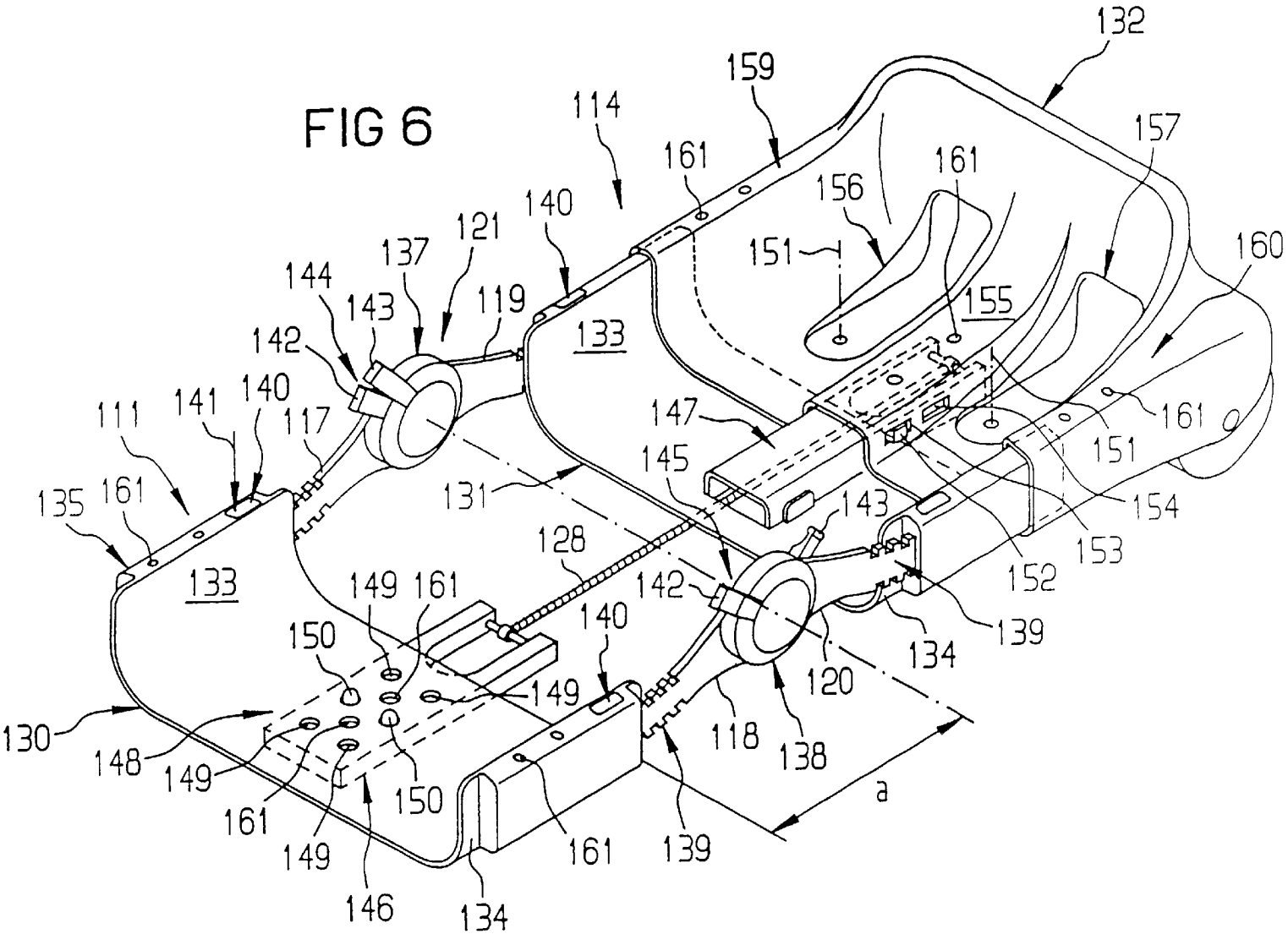
FIG. 6 shows the therapy and training equipment according to FIG. 5 in a separate conformation corresponding to a knee bending position of 0°.
Figure 7:
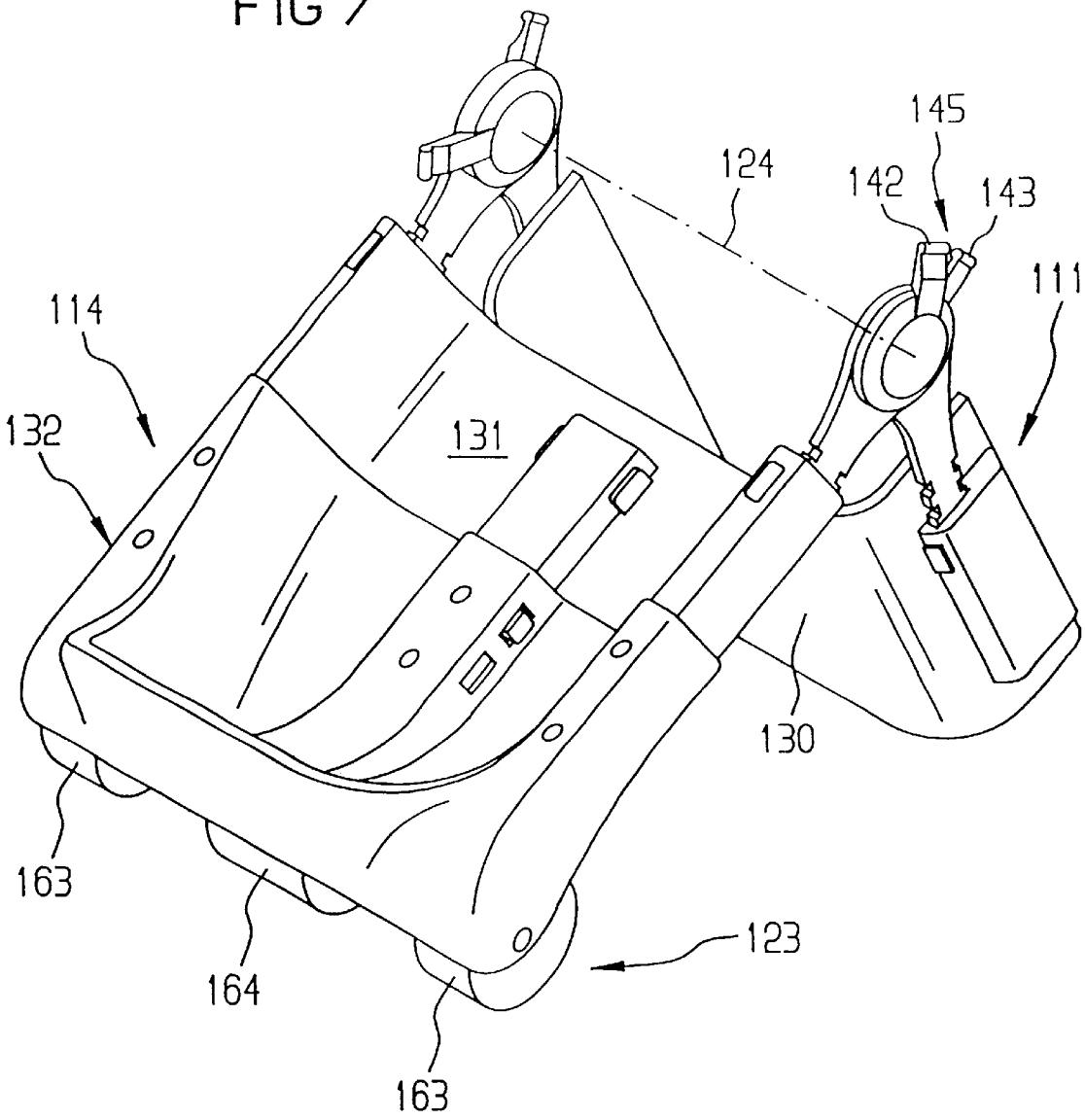
FIG. 7 shows the therapy and training equipment according to FIG. 6 in a knee bending position of 90°.

Further details of the therapy and training equipment 110 will become clear from FIGS. 6 and 7, which show the therapy and training equipment 110 in a knee-stretching position (FIG. 6) and a knee-bending position (FIG. 7).

The thigh receptacle 111 and the lower leg receptacle 114 have a corresponding thigh support 130 and a corresponding lower leg support 131, which in the present case are formed alike and are roughly capsule-shaped. The thigh receptacle 111 differs from the lower leg receptacle 114 in that, in addition to the lower leg support 131, it also has a foot capsule 132 that is connected in a detachable manner to the said lower leg support 131.

The thigh support 130 as well as the lower leg support 131 have guides 135, 136 arranged laterally on the outside of the side wall regions 133, 134, for receiving the rotating arms 117, 118 and 119, 120 of rotating joints 137, 138 of the articulated device 121. As is illustrated by way of example on the basis of the rotating arms 118, 120, the said rotating arms are each provided with a toothed locking device 139 which, on insertion of the rotating arms 117–120 into the guides 135, 136, cooperate with spring locking devices 140 formed like rotating key buttons. On insertion the spring locking devices 140 automatically engage in the toothed locking device 139. In order to remove the rotating arms 117–120 from the guides 135, 136, the spring locking devices 140 have to be disengaged from their spring-assisted engagement with the toothed locking device 139 by pressing on one side (as indicated by the arrow 141). In this way an effective lever length a can easily be adjusted between the rotational axis 124 connecting the rotating joints 137, 138 to one another, and the thigh support 130 and the lower leg support 131, so that the therapy and training equipment can quickly and easily be adapted to the patient's anatomy without any difficulty and without having to use a tool.

The rotating joints 137, 138 are each provided with two stop pins 142, 143 that cooperate together to form an angle stop 144 and 145 on, respectively, a rotating joint 137 and 138. The stop pins 142, 143 may be arranged in any arbitrary relative position on a rotating joint 137 or 138, so that in one case they can form an angle stop 144, 145 for a maximum knee-bending position, and in another case form an angle stop 144, 145 for a minimum knee-bending position. The respective limit position is defined by the setting of the stop pins 142, 143 relative to one another. FIG. 6 shows the stop pins 142, 143 of the rotating joint 137 in a relative arrangement in which they form an angle stop 144 for the knee-stretching position, whereas the stop pins 142, 143 of the rotating joint 138 are in a relative arrangement in which they form an angle stop 145 for the maximum knee bending position, as can be seen from FIG. 7.

As FIG. 6 also shows, both the thigh support 130 and the lower leg support 131 are provided with substantially matching spring couplings 146 and 147. As becomes clear from the diagram of the thigh support 130, a floor wall region 148 of the thigh support 130 as well as a corresponding floor wall region of the lower leg support 131 have, in the case illustrated here, a total of six securement bores 139 into which can be inserted two securement pins 150 of the spring coupling 146. Depending on which two of the securement bores 149 are selected to receive the securement pins 150, a specific relative arrangement of the spring coupling 146 on the thigh support 130 or on the lower leg support 131 can be selected. The pretension of an elastic cable 128 arranged between the spring couplings 146 and 147 can thus be adjusted.

In contrast to the spring coupling 146 on the thigh support 130, which is arranged in the underneath of the thigh support 130, the spring coupling 147 on the lower leg support 131 is arranged on the top of the latter. By means of the spring coupling 147 a central guide is thus at the same time formed for the foot capsule 132 displaceably arranged on the lower leg support 131. In addition to the spring coupling 147 serving as a central guide, the guides 135, 136 on the side wall regions 133, 134 of the lower leg support 131 serve for the lateral guidance of the foot capsule 132.

The foot capsule 132 has a central bracket 155 which is slipped over the spring coupling 147. The spring coupling 147 has at least one spring locking device 152 that cooperatively engages with corresponding locking recesses 153, 154 in the central bracket 155. FIG. 6 shows that the spring locking device 152 of the spring coupling 147 is latched or snap-fitted into the front locking recess 153 of the central bracket 155, so that the foot capsule 132 is almost in its "out" or disengaged position with respect to the lower leg support 131. This feature provides a further possibility of matching, in the region of the lower leg receptacle 114, the equipment to the patient's anatomy.

The foot capsule 132 has two capsule-shaped foot guides 156, 157 separated by the central bracket 155, which guides can be rotated within the foot capsule 132 about a height axis 151 arranged transverse to the rotational axis 124 of the articulated device 121. In this way it is possible to compensate incorrect settings, for example an incorrect "X" or "O" setting, so as to avoid any tensions and stresses in the patient's knee during a movement therapy.

In the heel region 122 of the foot capsule 132 the roller guide 133 is provided with three rollers 163. The rollers 163 are in this case relatively wide and thus particularly suitable for rolling on a soft, pliable surface, such as a bed mattress.

As can also be seen from FIGS. 6 and 7, the thigh support 130 is provided with securement bores 161 in the middle lower wall region 148 and on the top of the guides 135, 136, and the foot capsule 132 is provided with securement bores 161 on the central bracket 155 as well as on the upper side of its side brackets 159, 160, the said bores serving to receiving locking nipples 162 of the thigh securement device 126 and of the lower leg securement device 127. In the present case the thigh securement device 126 is identical to the lower leg securement device 127, and is shown in FIG. 9.

The thigh securement device 126 and the lower leg securement device 127 each has a base part 165 that can be inserted via the locking nipples 162 into the upper side of the floor wall region 148 of the thigh support 130 and/or into the central bracket 155 of the foot capsule 132 via an elastic, releasable locking engagement with the securement bores 161.

Figure 9:
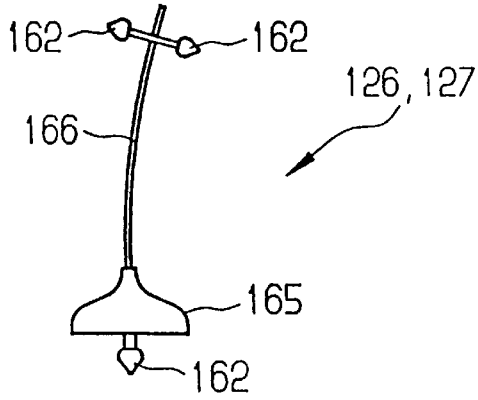
FIG. 9 shows a thigh or lower leg securement device for use in the therapy and training equipment according to FIG. 7.

The thigh securement device 126 and the lower leg securement device 127 illustrated in FIG. 9 have, starting from the base 165, an elastic strap 166 that can be fastened as desired over one or other of the thighs 112, 113 or over one or other of the lower legs 115, 116 of the patient (FIG. 5), the locking nipples 162 on the end of the strap 166 serving to effect an elastically releasable locking engagement in the corresponding securement bores 161 on the upper side of the guides 135, 136 of the thigh support 130 and on the side brackets 159, 160 of the foot capsule 132. By way of variation from the embodiment shown in FIG. 9, the thigh securement device 126 and the lower leg securement device 127 may also be provided with two straps so that both thighs 112, 113 or both lower legs 115, 116 can be securely strapped to the thigh support 130 or the lower leg support 131.

Figure 8:
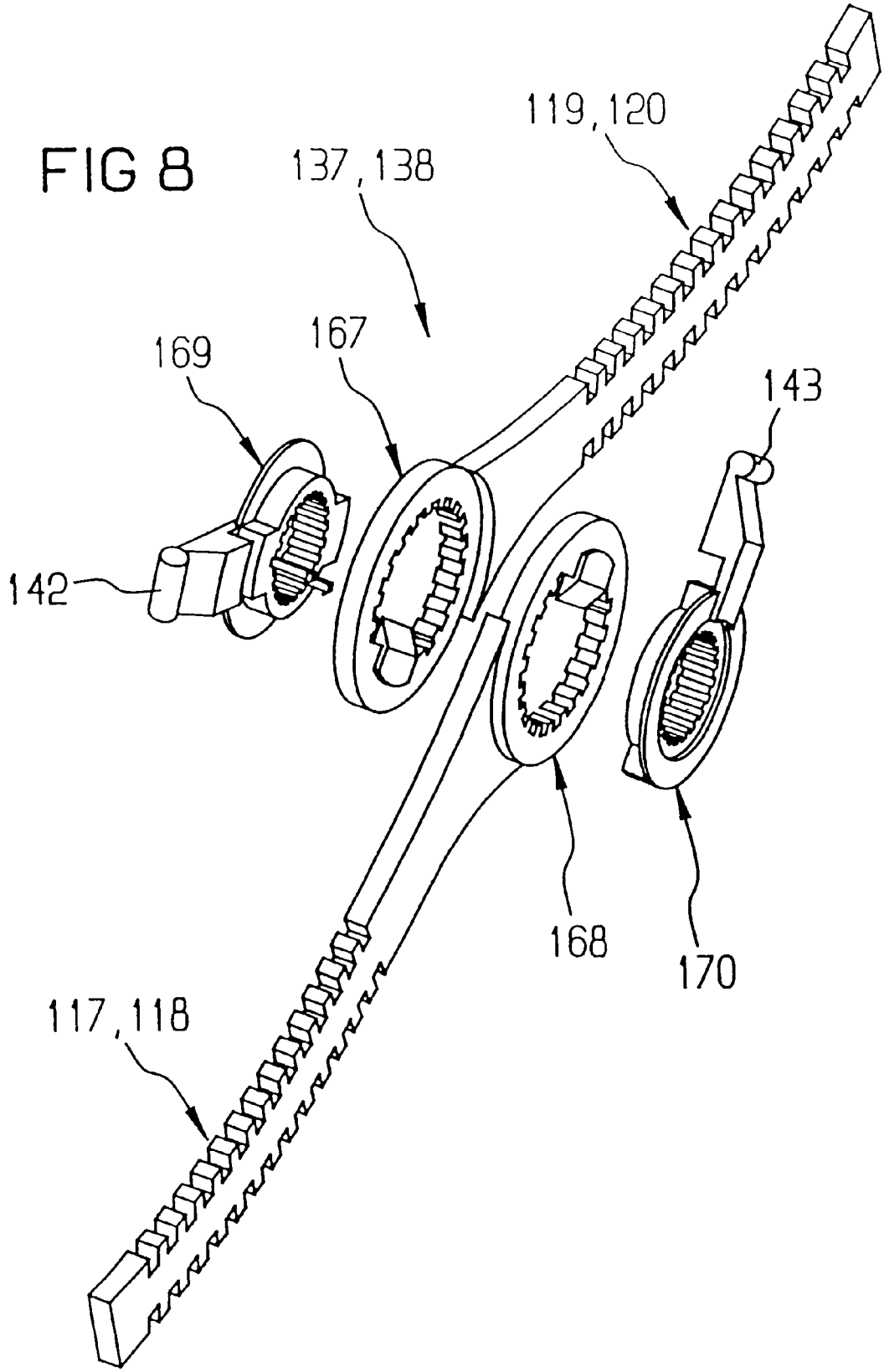
FIG. 8 is an exploded view of an articulated device of the therapy and training equipment.

FIG. 8 shows a possible embodiment of a rotating joint 137, 138 with the rotating arms 117, 119 and 118, 120 mounted thereon. The actual rotating joint 137, 138 is formed by joint eyes 167, 168 in the rotating arms 117, 119 and 118, 120, which eyes can be pressed against one another in such a way by the bilateral insertion of mutually engaging locking rings 169, 170, that the eyes can slide over one another. The locking rings 169, 170 are provided with the stop pins 142, 143, whose function has already been described. It will be clear from the illustration according to FIG. 8 that in this case the function of the rotating joints provided with rotating arms is achieved with a minimum number of parts.

In order to be able to accomplish on the embodiment of the therapy and training equipment illustrated here the elastic locking connections described several times hereinbefore, a version of the therapy and training equipment made of plastics material is particularly suitable.

Figure 10:
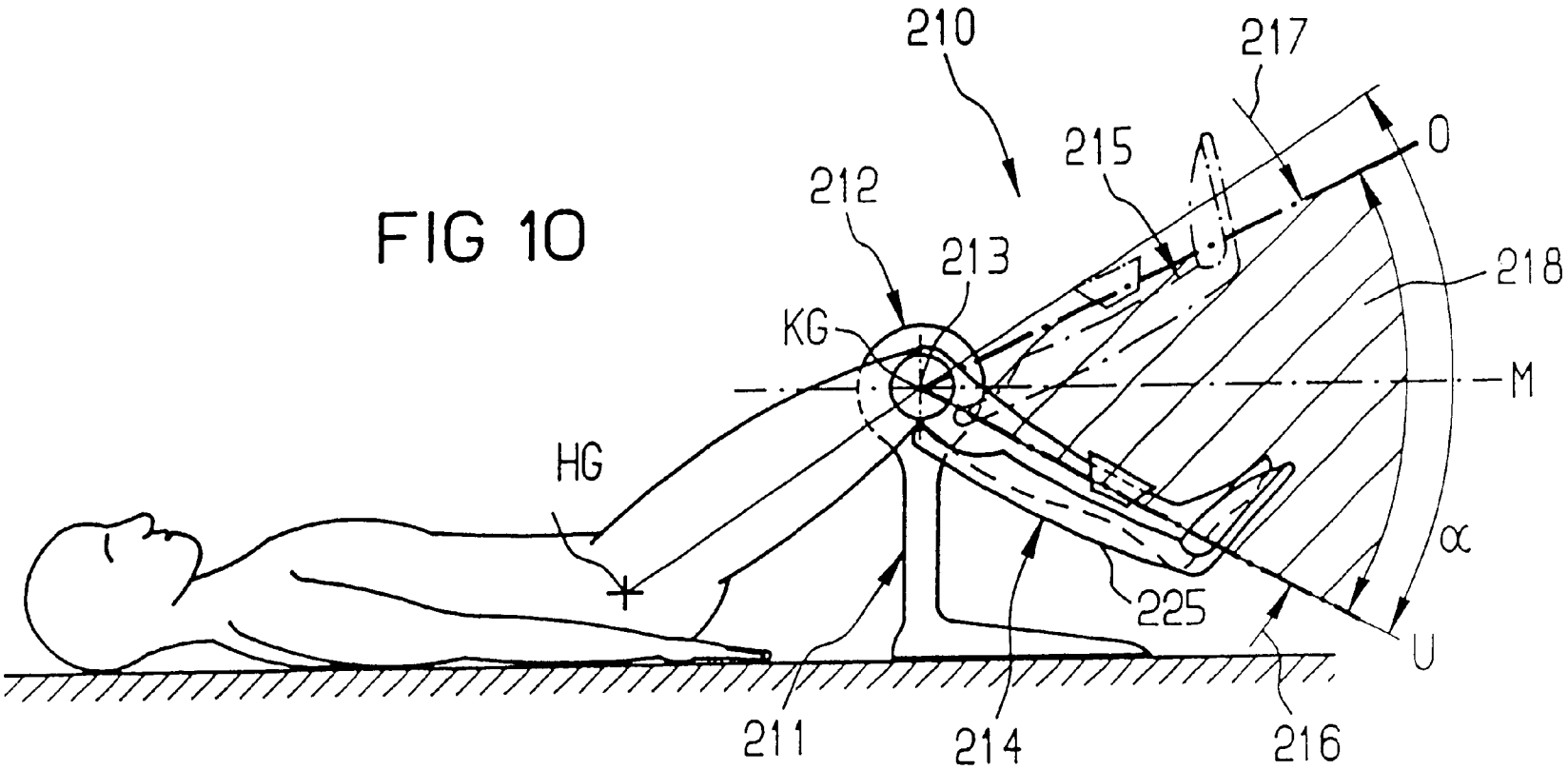
FIG. 10 is a further embodiment of a therapy equipment installed on a patient in a maximum bending position.

FIG. 10 shows a therapy equipment 210 with a rotating joint arrangement 212 arranged on a supporting device 211 and two lower leg receptacles 214, 215 arranged on a rotating joint axis 213 of the rotating joint arrangement 212, in which connection for the sake of clarity the lower leg receptacle 215 is represented only by its longitudinal axis.

The movements of the lower leg receptacles 214, 215 are coupled to one another via the rotating joint arrangement 212 in such a way that an upwards rotational movement of the lower leg receptacle 214, illustrated in FIG. 10 by the arrow 216, produces a constrained downwards rotational movement of the lower leg receptacle 215, illustrated in FIG. 10 by the arrow 217. The same comments apply as regards a downwards rotational movement of the lower leg receptacle 214, which produces a constrained upwards rotational movement of the lower leg receptacle 215.

As a result of the rotation-articulated coupling of the lower leg receptacles 214, 215 to the rotating joint arrangement 212, the lower leg receptacles 214, 215 are guided over a total rotational movement range 218 in two mutually parallel planes of rotation 219, 220 (FIG. 11), with the result that no transverse loads harmful for the knee joints can occur.

The lower leg receptacles 214, 215 are designed so that, on accommodating a patient's legs 221, 222, the knee joint axes of rotation KG of the patient's legs adopt or can be adjusted to an arrangement that is congruent to the rotating joint axis 213 of the therapy equipment 210. Such an adjustment can be achieved in the therapy equipment 210 illustrated in FIG. 10 by means of an accommodating capsule 225 of the lower leg receptacle 214 that can be altered as regards is setting relative to the rotating joint axis 213. As for the rest, the lower leg receptacles 214, 215 can be dimensioned so that, in the case of legs of average anatomy, the greatest possible congruence between the knee joint rotational axes KG of a patient and the rotating joint axis 213 of the therapy equipment 210 can be achieved to start with, i.e. without any necessary adjustment.

In the basic version of the therapy equipment 210 shown in FIG. 10, the spatial position of the rotating joint axis 213 is fixed via the supporting device 211, which can be altered horizontally as regards its position, so that with a congruent arrangement of rotating joint axis 213 and knee joint axes KG these in addition to a hip joint rotational axis HG of the patient are arranged in a spatially fixed manner and the knee bending angle $\alpha$ can be altered simply by rotating the lower leg receptacles 214, 215 about the rotating joint axis 213 of the rotating joint arrangement 212 over the rotational movement range 218. The limits of the rotational movement range 218 are defined by a lower end position U and an upper end position O of the lower leg receptacles 214, 215. In a mid position M the lower leg receptacles 214 and 215 moved in opposite directions in the therapy equipment 210 illustrated in FIG. 10 are situated in a common plane parallel to an underneath surface defined for example by a bed mattress 228, so that in this mid position it is possible to find a rest position that is comfortable for the patient.

As a consequence of the arrangement of the lower leg receptacles 214, 215 on a common rotating joint axis 213, the load forces acting about the rotating joint axis 213 as a result of the weight of the patient's lower legs are compensated, with the result that a movement of the lower legs over the rotational movement range 218 can be executed with the minimum force expenditure.

FIG. 11 shows diagrammatically the operating principle of the rotating joint arrangement 212 used in the form of a gear mechanism in the therapy equipment 210. In the design of the rotating joint arrangement 212 illustrated in FIG. 11 this is in the form of a miter gear mechanism with two drive wheels 231, 232 in each case rotationally rigidly connected to rotating arms 229, 230 of the lower leg receptacles 214, 215, the said drive wheels being mounted on the rotating joint axis 213 in the housing 233 of the rotating joint arrangement 212. A transmission wheel 234 is arranged in the housing 233 on a transmission shaft 235 arranged at right angles to the rotating joint axis 213, in order to transmit torque between the drive wheels 231 and 232. As will become clear from the diagram according to FIG. 11, a clockwise rotational movement of the rotating arm 230 about the rotating joint axis 213 initiated for example by the patient's healthy leg produces via the transmission wheel 234 a corresponding anticlockwise rotational movement of the rotating arm 229, resulting in the involvement of the patient's injured leg accommodated in the lower leg receptacle 215 connected to the rotating arm 229. The movements of the rotating arm 229, 230 are produced in a constrained manner via the rotating joint arrangement 212, with the result that every rotational movement of a rotating arm 229 or 230 produces a rotational movement in the opposite direction of the other rotating arm 229 or 230.

In addition to the version of the rotating joint arrangement in the form of a miter gear mechanism and involving for example toothed wheels or friction wheels, other gear principles may be used that permit the aforedescribed constrained coupled movement.

The rotating joint arrangement 212 illustrated in FIG. 11 is in addition provided with an adjustable loading device 236 that permits a loading moment 238 acting in the opposite direction to be superimposed as a gear mechanism load on the transmission torque 237 transmitted by the transmission wheel 234. The loading device 236 has in the embodiment illustrated here a brake disc 239 rotationally rigidly connected to the transmission wheel 234, the brake disc being provided with brake blocks 240, 241 that can be adjusted as regards their action on the brake disc 239 via an actuating device 242 arranged externally on the housing 233.

An adjustable stop device 243 provided with two stops 244, 245 is also arranged externally on the housing 233, which stops are adjusted so that they limit the rotational amplitude of the rotating arm 230 in both directions and thus define the end positions O and U (FIG. 10) of the lower leg receptacles 214, 215. In order to adjust the mid position M shown in FIG. 10 or also a mid position differing therefrom as regards its angular position relative to the horizontal, the whole housing 233 may be designed so that it can rotate or swivel about the rotating joint axis 213.

Figure 12:
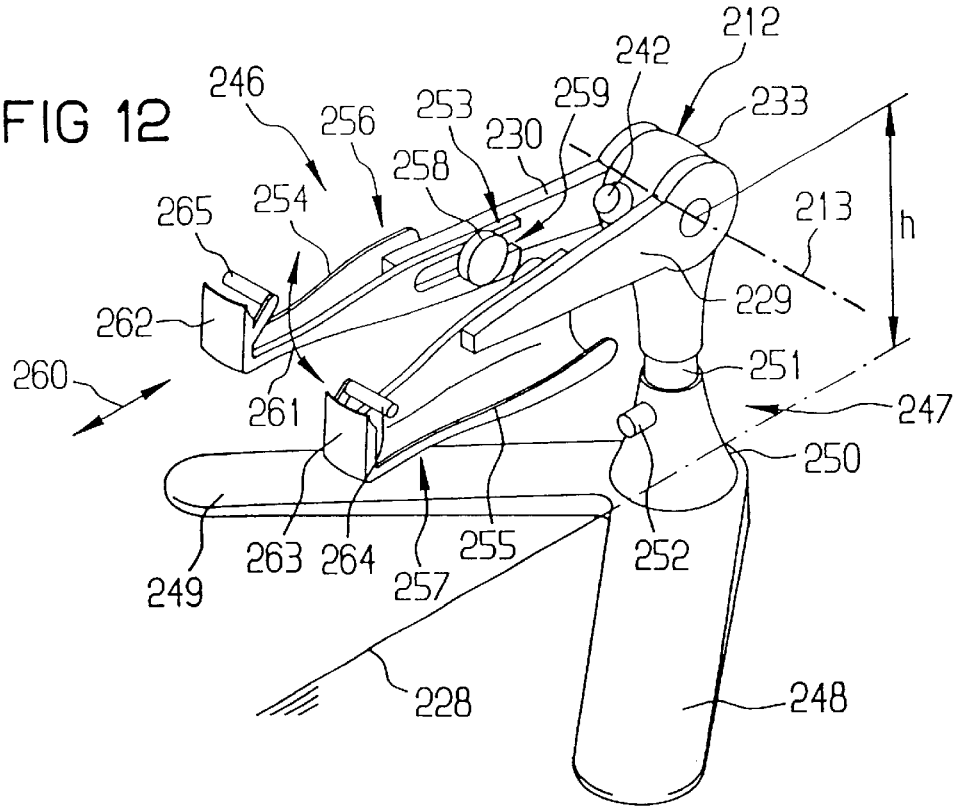
FIG. 12 is an exemplary embodiment of the therapy equipment according to FIG. 10 in a spatial representation, the lower leg receptacles coupled to the rotating joint arrangement being in a middle position.
Figure 13:
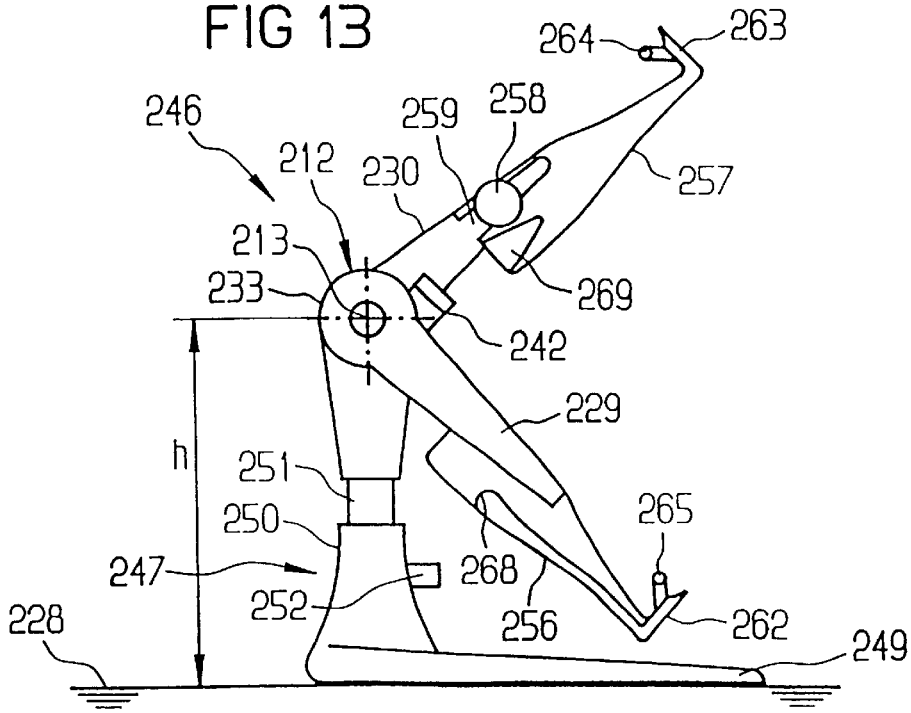
FIG. 13 shows the therapy equipment illustrated in FIG. 12 in a representation of the lower leg receptacles in the end positions of their rotational movement range.

FIGS. 12 and 13 show in a further embodiment a therapy equipment 246 in a mid position configuration (FIG. 12) and in an end position configuration (FIG. 13). The therapy equipment 246 has a socket shaped plinth-like supporting device 247 with feet 248, 249 arranged in the form of a V and a socket 250 mounted thereon, which is provided with a height adjustment device (not shown in more detail in FIGS. 10, 12 and 13), to enable the height h of the rotating joint axis 213 of the rotating joint arrangement 212 to be varied relative to, for example, the supporting surface formed by the bed mattress 228.

In the embodiment illustrated here the housing 233 of the rotating joint arrangement 212 is in the form of a tube in a socket connecting part 251, so that it can be guided in a height-adjustable manner in the socket 250. A fastening device 252 arranged externally on the socket serves to fix the selected height h.

On the rotating joint axis 213 the rotating arms 229, 230 are coupled on both sides to the rotating joint arrangement 212.

Accommodating capsules 254, 255 are mounted on the rotating arms 229, 230 via a releasable connecting device 253, the capsules in each case forming, together with a rotating arm 229, 230, the lower leg receptacles 256, 257. The connecting device 253 in the embodiment illustrated here has a clamping screw 258 screwed into the rotating arms 229, 230, which screw passes through a clamping slit 259 arranged laterally in the lower leg receptacles 256, 257 so that, when the clamping screw 258 is released, a relative movement of the accommodating capsules 254, 255 in the longitudinal direction of the rotating arms 229, 230 (arrow 260) as well as a rotational movement of the accommodating capsules 254, 255 about the clamping screw 258 (arrow 261) is possible. By bracing and clamping the accommodating capsules 254, 255 with the rotating arms 229 or 230 with the clamping screw 258 screwed in, a freely chosen relative setting of the accommodating capsules 254, 255 with respect to the rotating arms 229, 230 and to the rotating joint axis 213 can be fixed in position, so that the congruent alignment, already explained with reference to FIG. 10, between the rotating joint axis 213 of the rotating joint arrangement 212 and the knee-joint rotational axes KG of the patient can easily be adjusted at all times.

As is further evident from FIGS. 12 and 13, the accommodating capsules 254, 255 have, in addition to the lower leg receptacles 256, 257, also foot receptacles or foot supports 262, 263. Roughly L-shaped and adjustable retaining straps 264, 265 are arranged in the region of the foot supports 262, 263 at a distance from the internal surface of the lower leg receptacles 256, 257, which are intended to ensure a reliable and effective force transmission between the patient's knee and the respective lower leg receptacle 214 or 215 also in the case of an active upwards movement. The retaining straps 264, 265 are open on the outside so that once the gap between the retaining straps 264, 265 and the lower leg receptacle 256 or 257 has been suitably adjusted, this procedure no longer has to be repeated and the patient can easily insert his foot into and remove it from the lower leg receptacles 214, 215 by lateral insertion or removal of the lower leg into or from the lower leg receptacle 256, 257.

As will be clear in particular from FIG. 13, the capsule-shaped lower leg receptacles 256, 257 have recesses 268, 269 in a wall region that permit a positioning of the lower legs in the lower leg receptacle 256, 257 that is particularly comfortable for the patient.

The diagrams in FIGS. 12 and 13 also make it clear that the therapy equipment is particularly inexpensive to manufacture on account of the relatively small number of parts. This is particularly true for the case where the arrangement of the therapy equipment on a patient's bed does not involve the supporting stand configuration with a socket-shaped supporting device 247 illustrated in FIGS. 12 and 13, but instead a suspended configuration is chosen in which the rotating joint arrangement is connected to a beam or bar device (not shown in more detail here) arranged above or on the patient's bed. The important point is simply to establish a position of the rotating joint axis 213 that is defined and fixed in its arrangement relative to the hip joint rotation axis HG.

Figure 14:
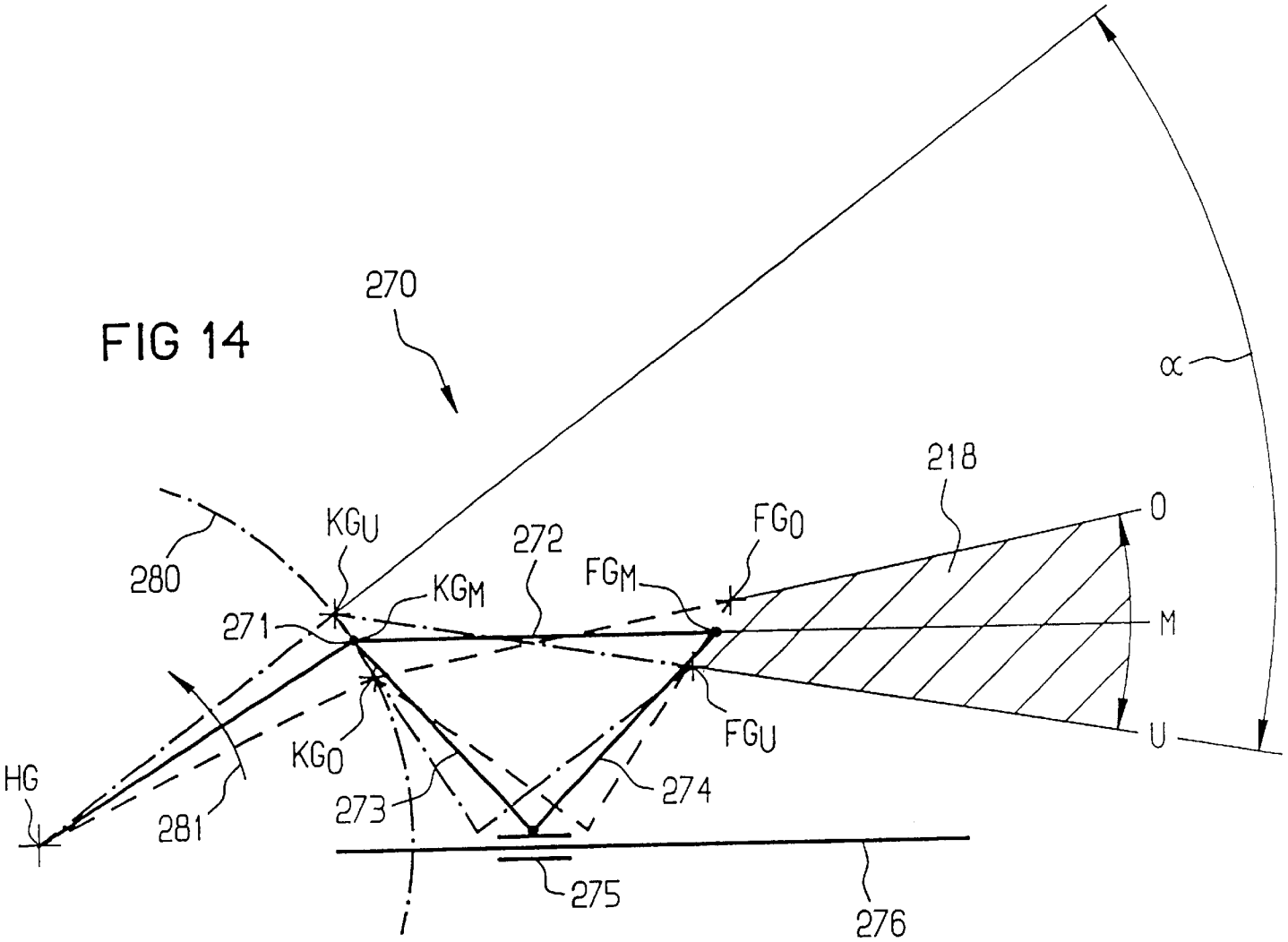
FIG. 14 is a diagrammatic representation of the kinematic relationships in a therapy equipment with the rotating joint axis of the rotating joint arrangement guided on a movement path with respect to the conformation of the therapy equipment illustrated in FIG. 10.

FIG. 14 shows the kinematic relationships in a therapy equipment 270 that has a rotating joint axis 271 that can move concentrically about the hip-joint rotational axis HG of the patient. The kinematics illustrated in FIG. 14 enable the rotational movement of the lower leg about the rotating joint axis 271 to be utilized simultaneously and in conjunction with a displacement of the rotating joint axis 271 on a movement path 280 concentric with the hip-joint rotation axis HG of the patient in order thereby to be able to simulate the movement sequences of running. In order to simplify the illustration, in FIG. 14 a lower leg receptacle 272 is represented only by its longitudinal axis as a straight line between the rotating joint axis 271 and/or the knee-joint rotational axis KG and the ankle rotational axis FG of the patient in various rotational movement phases, namely the mid position M, the upper end position O and the lower end position U, of the rotational movement range. In the therapy equipment 270 the lower leg receptacle 272 is connected by rods 273, 274 via a sliding guide 275 to a stationary guide bar 276 that in this case runs horizontally. Instead of the rods 273, 274 shown in FIG. 14, it is of course also possible to connect a rigid extension arm (not shown here in more detail) to the lower leg receptacle 272 and to couple it in an articulated manner to the sliding guide 275 in order to obtain the same kinematic result.

It becomes clear from FIG. 14 that a rotation of the lower leg receptacle 272 starting from the mid position M to the lower end position U via the sliding guide 275 produces a constrained movement (arrow 281) of the rotating joint axis 271. The lower leg receptacle 272 now extends over the straight line between the knee-joint rotation point in the lower end position $KG_u$ and the ankle rotation point in the lower end position $FG_u$.

Similar comments apply as regards a rotation or swivelling of the lower leg receptacles 272 to the upper end position O (connecting straight lines between the knee-joint rotation point in the upper end position $KG_o$ and the ankle rotation point in the upper end position $FG_o$).

From FIG. 14 it is also clear that, on account of the superimposed rotational movements between the thigh, which extends over the connecting straight line between the hip-joint rotation point HG and the knee-joint rotation point KG, and the lower leg, a roughly equally large knee-bending angle $\alpha$ can be achieved with substantially smaller rotational amplitude 218 of the lower leg receptacle, compared to a locally fixed and stationary rotating joint axis 213 as illustrated for example in FIG. 10.

FIG. 15 shows diagrammatically one possible way of designing a supporting device 277 that permits a kinematic behaviour as illustrated in FIG. 14, with movement of the rotating joint axis 271 on a movement path 280 that is concentric to the hip-joint rotation axis HG of the patient. To this end the rotating joint axis 271 is accommodated in a horizontally acting sliding guide 278, the said sliding guide 278 being vertically displaceably guided via a rod 279 in a socket 280.

What is claimed is:

1. A therapy and training equipment for constrained knee joint movement comprising a lower leg accommodating for accepting a first and a second lower leg of a patient, the first and the second lower leg being fixedly attached to the lower leg accommodating arrangement;

a guiding arrangement; and an articulator for transmitting to the lower leg accommodating arrangement a rotational drive produced by muscular power;

wherein the guiding arrangement and the lower leg accommodating arrangement are connected by the articulator in such a way that the first lower leg, upon engaging in a rotational movement, forcibly moves the second lower leg as a result of the knee-bending movement in both directions of an oscillating movement sequence.

2. The therapy and training equipment according to claim 1, wherein the guiding arrangement is formed as a guide rail and is connected to the lower leg accommodation arrangement by a rotation device which is longitudinally displaceably guided in the guide rail.

3. The therapy and training equipment according to claim 2, wherein the lower leg accommodating arrangement serves as a directional movement coupling accommodation of both legs in such a way that, upon initiating the rotational movement of the first lower leg, the second lower leg moves in the same direction as the first leg.

4. A therapy and training equipment for constrained knee joint movement comprising a leg accommodating arrangement for accepting a first and a second lower leg of a patient;

the leg accommodating arrangement having a heel part;

an articulator having a first and a second end, the first end being glideably connected to the guiding arrangement and the second end being fixedly connected to the heel part of the leg accommodating arrangement; and wherein, upon a knee bending movement of at least one leg, a movement of the leg accommodating arrangement in the guide arrangement is provided, forcibly moving the other leg as a result of the knee-bending movement.

5. A therapy and training equipment for constrained knee joint movement according to claim 4, further comprising a counter for counting the number of knee-bending movement.

6. A therapy and training equipment for constrained knee joint movement comprising two leg accommodating arrangements, each accepting one lower leg of a patient;

the leg accommodating arrangements each having a heel part;

two articulators, each having a first and second end, the first end being glideably connected to each gliding arrangement and the second end being fixedly connected to the heel part of each leg accommodating arrangement; and wherein, upon a knee bending movement of at least one leg, a movement of the leg accommodating arrangement in the guide arrangement is provided, forcibly moving the other leg as a result of the knee-bending movement.

* * * * *